US010163426B2

(12) United States Patent
Yoshino

(10) Patent No.: US 10,163,426 B2
(45) Date of Patent: Dec. 25, 2018

(54) BASS DRUM DAMPER AND BASS DRUM

(71) Applicant: Roland Corporation, Shizuoka (JP)

(72) Inventor: Kiyoshi Yoshino, Shizuoka (JP)

(73) Assignee: Roland Corporation, Shizuoka (JP)

( * ) Notice: Subject to any disclaimer, the term of this patent is extended or adjusted under 35 U.S.C. 154(b) by 0 days.

(21) Appl. No.: 15/756,984

(22) PCT Filed: Jun. 28, 2016

(86) PCT No.: PCT/JP2016/069133
§ 371 (c)(1),
(2) Date: Mar. 2, 2018

(87) PCT Pub. No.: WO2017/038226
PCT Pub. Date: Mar. 9, 2017

(65) Prior Publication Data

US 2018/0261192 A1 Sep. 13, 2018

(30) Foreign Application Priority Data

Sep. 4, 2015 (JP) ..... 2015-174463

(51) Int. Cl.
*G10D 13/02* (2006.01)
*G10D 13/00* (2006.01)
*G10H 3/14* (2006.01)

(52) U.S. Cl.
CPC ..... *G10D 13/021* (2013.01); *G10D 13/00* (2013.01); *G10D 13/02* (2013.01); *G10H 3/14* (2013.01)

(58) Field of Classification Search
CPC ..... G10D 13/021
See application file for complete search history.

(56) References Cited

U.S. PATENT DOCUMENTS 4,254,685 A * 3/1981 Rose ..... G10D 13/027 84/411 R
5,492,047 A 2/1996 Oliveri
(Continued)

FOREIGN PATENT DOCUMENTS

GB 2321994 A * 8/1998 ..... G10D 13/021
JP S49-039424 7/1972
(Continued)

OTHER PUBLICATIONS

"Written Opinion of the International Searching Authority (Form PCT/ISA/237)" of PCT/JP2016/069133, dated Sep. 13, 2016, with English translation thereof, pp. 1-9.
(Continued)

*Primary Examiner* — Robert W Horn
(74) *Attorney, Agent, or Firm* — JCIPRNET

(57) ABSTRACT

A bass drum damper and a bass drum are provided. The bass drum damper includes a sound insulating plate that covers a batter head of an acoustic bass drum generating a percussive sound when a beater of a foot pedal percusses a predetermined percussion location. The sound insulating plate includes a contact portion having an opening portion open for the percussion location for the beater and is in contact with the batter head, and a fixing portion provided at a circumferential edge of the contact portion and fixed to a hoop applying a tensile force to the batter head, or the batter head. At least a part of the contact portion which is in contact with the batter head when not being percussed is separated from the batter head at a time of percussing of the beater and is brought into contact with the batter head again after percussing.

20 Claims, 6 Drawing Sheets

(56) References Cited

U.S. PATENT DOCUMENTS

| | | | | |
|---|---|---|---|---|
| 5,892,168 | A * | 4/1999 | Donohoe | G10D 13/022 84/411 M |
| 6,686,526 | B2 | 2/2004 | Ezbicki | |
| 7,214,867 | B1 * | 5/2007 | Gatzen | G10D 13/027 84/411 R |
| 7,476,794 | B2 * | 1/2009 | May, Jr. | G10D 13/021 84/411 R |
| 7,582,820 | B2 | 9/2009 | Millender, Jr. et al. | |
| 7,763,788 | B2 * | 7/2010 | Wachter | G10D 13/06 84/411 M |
| 7,932,452 | B2 * | 4/2011 | Chen | G10D 13/027 84/411 R |
| 8,039,724 | B1 | 10/2011 | Norman et al. | |
| 8,148,619 | B1 * | 4/2012 | May | G10D 13/022 84/411 M |
| 8,916,759 | B2 * | 12/2014 | Hashimoto | G10D 13/027 84/411 R |
| 8,962,962 | B2 * | 2/2015 | Jones | G10D 13/027 84/411 R |
| 9,159,305 | B1 * | 10/2015 | Mazzarisi | G10D 13/021 |
| 9,190,040 | B2 * | 11/2015 | Hashimoto | G10D 13/027 |
| 9,208,759 | B2 * | 12/2015 | Millender, Jr. | G10D 13/021 |
| 9,257,107 | B1 * | 2/2016 | Belli | G10D 13/021 |
| 2013/0312585 | A1 * | 11/2013 | Yunbin | G10D 13/027 84/414 |
| 2014/0069256 | A1 | 3/2014 | Hashimoto | |
| 2014/0069257 | A1 | 3/2014 | Hashimoto | |
| 2015/0082967 | A1 * | 3/2015 | Yoshino | G10D 13/022 84/411 M |
| 2015/0243266 | A1 | 8/2015 | May | |
| 2018/0261192 | A1 * | 9/2018 | Yoshino | G10D 13/00 |

FOREIGN PATENT DOCUMENTS

| | | |
|---|---|---|
| JP | H2-34717 | 9/1990 |
| JP | 2006047557 | 2/2006 |
| JP | 2012145915 | 8/2012 |
| JP | 2015079172 | 4/2015 |

OTHER PUBLICATIONS

"International Search Report (Form PCT/ISA/210)"of PCT/JP2016/069133, dated Sep. 13, 2016, with English translation thereof, pp. 1-4.

* cited by examiner

BASS DRUM DAMPER AND BASS DRUM

CROSS-REFERENCE TO RELATED APPLICATION

This application is a 371 application of the International PCT application serial no. PCT/JP2016/069133, filed on Jun. 28, 2016, which claims the priority benefit of Japan application serial no. 2015-174463, which was filed on Sep. 4, 2015. The entirety of each of the above-mentioned patent applications is hereby incorporated by reference herein and made a part of this specification.

BACKGROUND OF THE INVENTION

Field of the Invention

The present invention relates to a bass drum damper and a bass drum. Particularly, the present invention relates to a bass drum damper and a bass drum capable of reducing a percussive sound and maintaining the unique timbre of an acoustic bass drum.

Description of Related Art

There are known dampers reducing the volume of a sound generated when a drum is played in an environment in which playing at a loud volume is required to be avoided. Examples of the dampers include a damper in which a silencing member provided with an opening portion adheres to a batter head of a drum (tam-tam) with its entire surface or is integrally molded with the batter head, and the batter head is percussed through the opening portion (Patent Literature 1). In such a damper, a percussive sound can be reduced by the silencing member which attenuates vibration of the batter head in an early stage.

PRIOR ART LITERATURE

Patent Literature

[Patent Literature 1]

U.S. Pat. No. 4,254,685

However, in Patent Literature 1, since a silencing member adheres to a batter head with its entire surface or is integrally molded with the batter head, free vibration of the batter head is hindered. Thus, Patent Literature 1 has a problem that the unique timbre of an acoustic drum is impaired.

BRIEF DESCRIPTION OF THE DRAWINGS

FIG. 1(*b*) is a front view of the bass drum in which the bass drum damper is mounted.

FIG. 3(*b*) is a rear view of the percussion target portion.

FIG. 4(*b*) is a cross-sectional view of the bass drum and the bass drum damper illustrating a state where the percussion target portion is percussed.

DESCRIPTION OF THE EMBODIMENTS

Figure 1A:
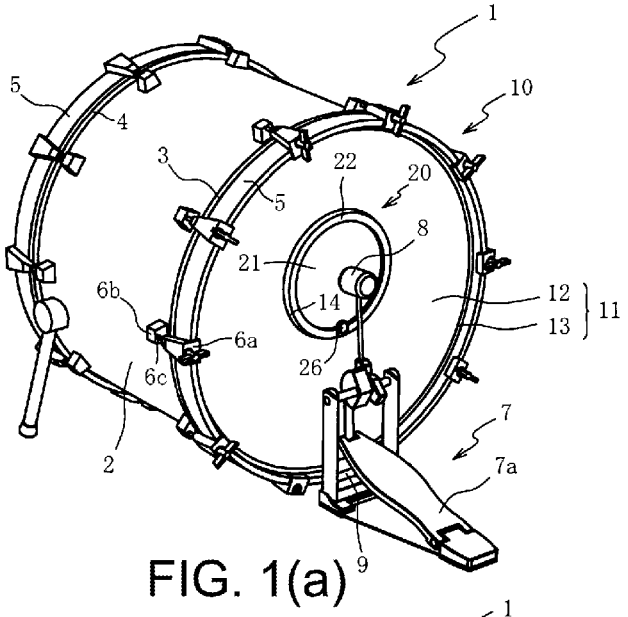
FIG. 1(*a*) is a perspective view of a bass drum in which a bass drum damper according to a first embodiment is mounted.
Figure 1B:
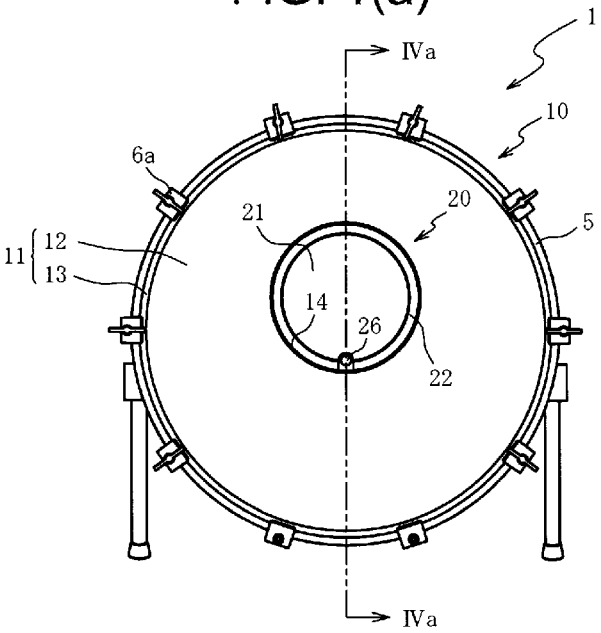
Figure 2:
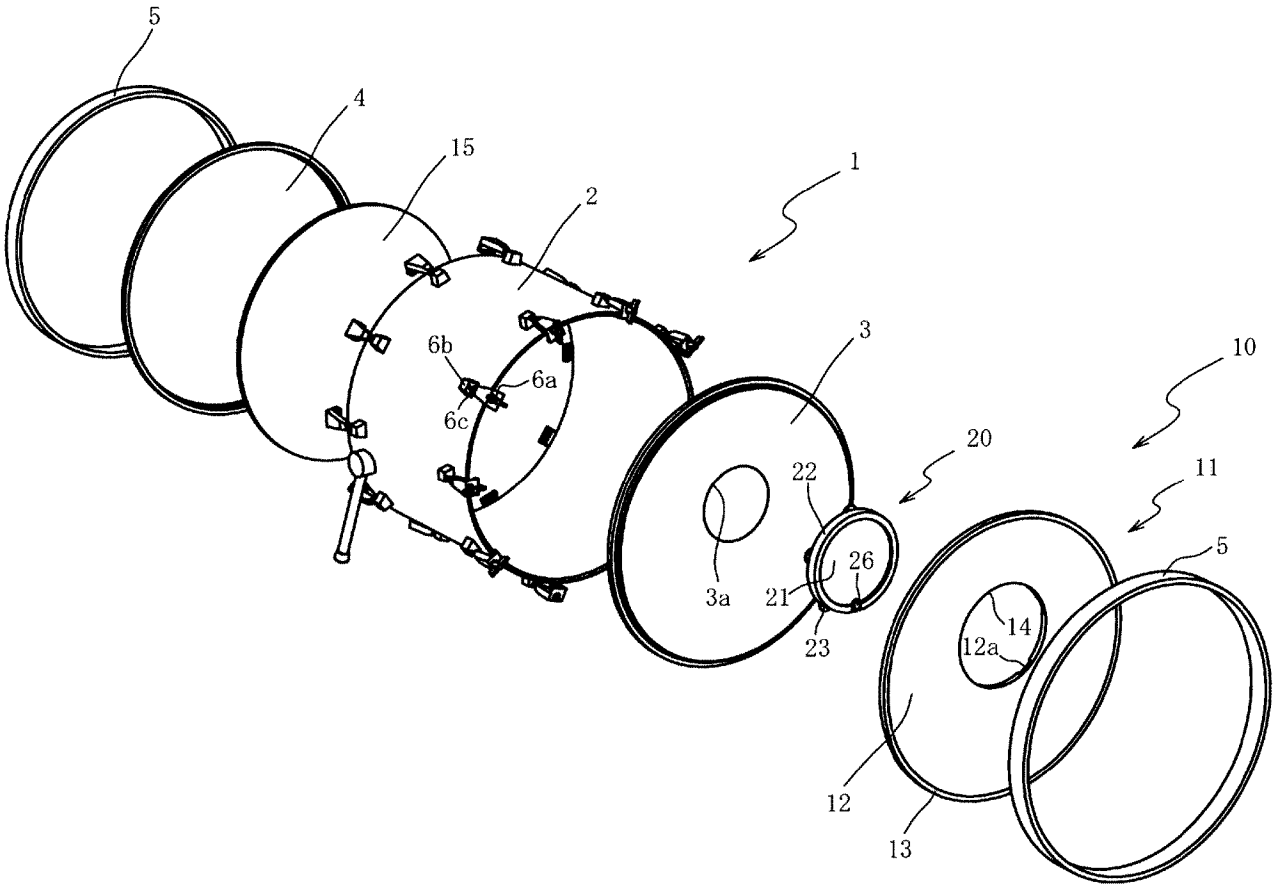
FIG. 2 is an exploded view of the bass drum and the bass drum damper.

Hereinafter, preferable embodiments will be described with reference to the accompanying drawings. First, with reference to FIGS. 1(*a*), 1(*b*), and 2, a bass drum 1 and a bass drum damper 10 (hereinafter, will be referred to as a "damper 10") according to a first embodiment will be described. FIG. 1(*a*) is a perspective view of the bass drum 1 in which the damper 10 according to the first embodiment is mounted. FIG. 1(*b*) is a front view (a view seen from a player side) of the bass drum 1 in which the damper 10 is mounted. FIG. 2 is an exploded view of the bass drum 1 and the damper 10.

As illustrated in FIGS. 1(*a*), 1(*b*), and 2, the bass drum 1 is an acoustic percussion instrument in which both ends of a cylindrical shell 2 are blocked with a batter head 3 and a resonance head 4 which are circular films. The bass drum 1 generates a percussive sound when the batter head 3 is percussed. In the bass drum 1, a hook 6*a* hooked to an annular hoop 5 is connected, through a tuning bolt 6*c*, to a lug 6*b* which is fixed to the shell 2. In the bass drum 1, the hook 6*a* moves toward the lug 6*b* when the tuning bolt 6*c* is fastened, and circumferential edges of the batter head 3 and the resonance head 4 are pressed by the hoop 5 so that a tensile force is applied to the batter head 3 and the resonance head 4.

A foot pedal 7 for percussing the batter head 3 is mounted in the bass drum 1. The foot pedal 7 percusses the batter head 3 with a beater 8 which pivots when a pedal 7*a* is stepped upon. A percussion location for the beater 8 in the batter head 3 is determined when the location, the length, and the like of the beater 8 are set in accordance with preferences of a player.

In the present embodiment, a circular batter opening portion 3*a* penetrating the percussion location for the beater 8 in a film thickness direction is provided in the batter head 3, and the batter opening portion 3*a* is covered with a percussion target portion 20 of the damper 10. The percussion target portion 20 is percussed instead of the batter head 3, and the bass drum 1 thereby generates a percussive sound. The percussion location for the beater 8 indicates a location in the batter head 3 percussed with the beater 8 when no percussion target portion 20 is mounted and indicates a location of the percussion target portion 20 percussed with the beater 8 when the percussion target portion 20 is mounted. Compared to a case where the batter head 3 is directly percussed with the beater 8, the percussion location for the beater 8 is located closer to the player side by as much as the thickness of the percussion target portion 20 in a case where the percussion target portion 20 is percussed with the beater 8. Therefore, the foot pedal 7 is mounted in the bass drum 1 via a spacer 9 between the foot pedal 7 and the bass drum 1.

The damper 10 is mounted in the bass drum 1 and reduces the volume of a sound generated at the time of playing. The damper 10 includes a sound insulating plate 11, a resonance side sound insulating plate 15, and the percussion target portion 20. The percussion target portion 20 is disposed at the percussion location for the beater 8 and is mounted on a surface of the batter head 3 on the player side.

The sound insulating plate 11 is formed in a disk shape covering the batter head 3. The sound insulating plate 11 reduces a percussive sound by shutting out the percussive sound generated from the batter head 3. The sound insulating plate 11 includes a contact portion 12 and a fixing portion 13.

The contact portion 12 is a wooden member having a disk shape and is in contact with the batter head 3. In the contact portion 12, an opening portion 14 penetrating the contact portion 12 in the plate thickness direction is provided substantially at the center. In the contact portion 12, a stepped portion 12*a* is provided on a surface on the batter head 3 side so as to avoid disk portions 24 of attachment tools 23 (described below). Since the contact portion 12 is a wooden member, that is, since the contact portion 12 is made of a porous material, the sound absorbing performance of the contact portion 12 (sound insulating plate 11) can be improved, and a percussive sound can be reduced. Examples of the wooden member include those of particle board, laminated wood, fiber board, plywood, and veneer.

The fixing portion 13 is made of soft polyurethane foam and is formed in an annular shape. The fixing portion 13 is provided on the entire circumference of the circumferential edge of the contact portion 12. The contact portion 12 and the fixing portion 13 are integrated with each other by causing the fixing portion 13 to adhere to the contact portion 12. The outer diameter of the fixing portion 13 is formed to be slightly larger than the inner diameter of the hoop 5 to the extent that the fixing portion 13 can be press-fitted into the hoop 5. Accordingly, when the fixing portion 13 is press-fitted into the hoop 5 and is fixed thereto, the sound insulating plate 11 is mounted in the bass drum 1. Moreover, it is preferable that the dimensions of the outer diameter of the fixing portion 13 be set such that the fixing portion 13 press-fitted into the hoop 5 is prevented from moving with respect to the hoop 5 due to vibration, an impact, and the like at the time of playing.

The opening portion 14 is a circular hole open for the percussion location for the beater 8. Therefore, the beater 8 can percuss the percussion target portion 20 through the opening portion 14. The opening portion 14 is located concentrically with respect to the batter opening portion 3*a* when the sound insulating plate 11 is mounted in the bass drum 1 and is formed to have a diameter larger than that of the batter opening portion 3*a*. Accordingly, in the damper 10, the surface of the batter head 3 on the player side, that is, a space for mounting the percussion target portion 20 can be ensured on the inner side of the opening portion 14.

The resonance side sound insulating plate 15 is made of soft polyurethane foam and is formed in a disk shape. The resonance side sound insulating plate 15 is in contact with a surface of the resonance head 4 on the player side. The outer diameter of the resonance side sound insulating plate 15 is formed to be larger than the inner diameter of the shell 2 and to be smaller than the outer diameter of the shell 2. When a tensile force is applied to the resonance head 4 by the hoop 5 in a state where the resonance side sound insulating plate 15 is interposed between an end portion of the shell 2 and the resonance head 4, the resonance side sound insulating plate 15 is fixed to the bass drum 1. Since the resonance side sound insulating plate 15 can suppress vibration of the resonance head 4, a percussive sound can be reduced. In addition, since the resonance side sound insulating plate 15 is located on the batter head 3 side of the resonance head 4, the resonance side sound insulating plate 15 is pressed toward the resonance head 4 due to an impact of percussing the batter head 3. As a result, the resonance side sound insulating plate 15 can be prevented from being separated from the resonance head 4.

Figure 3B:
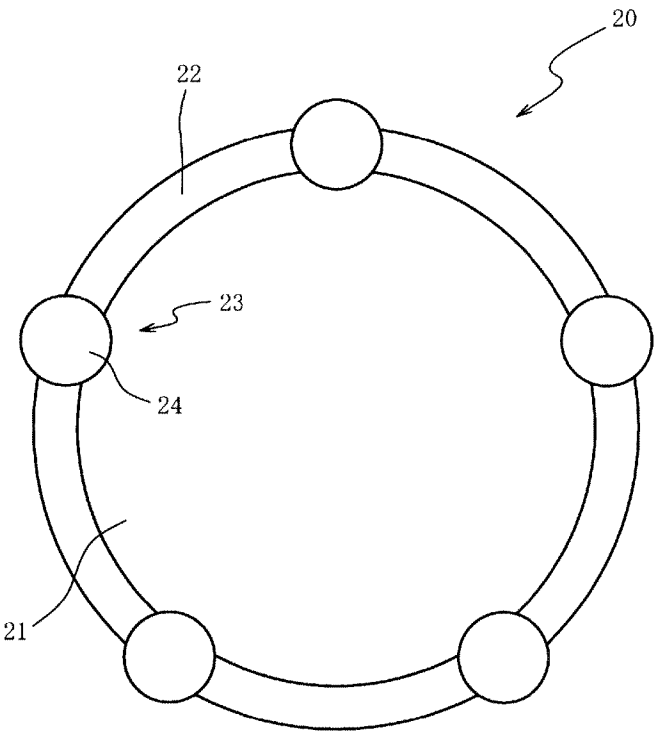
FIG. 3(*a*) is a front view of a percussion target portion.
Figure 3A:
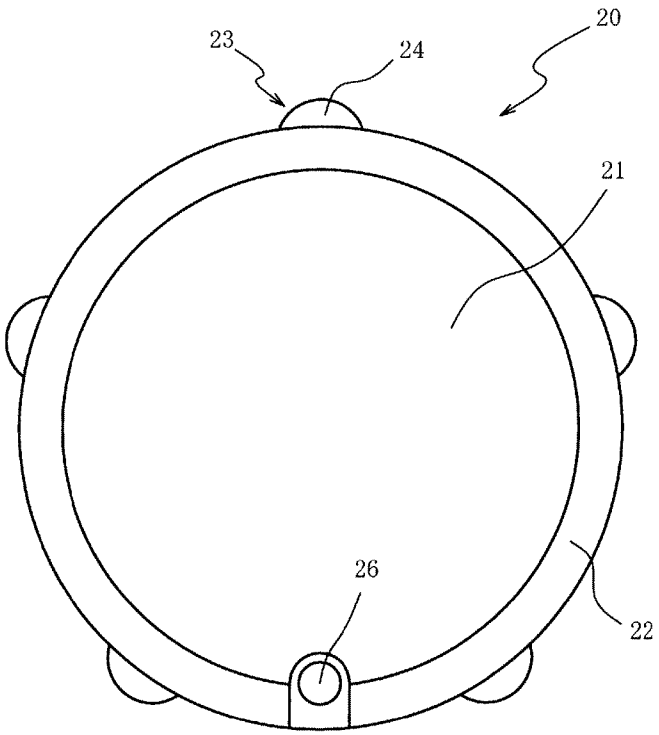
Figure 4B:
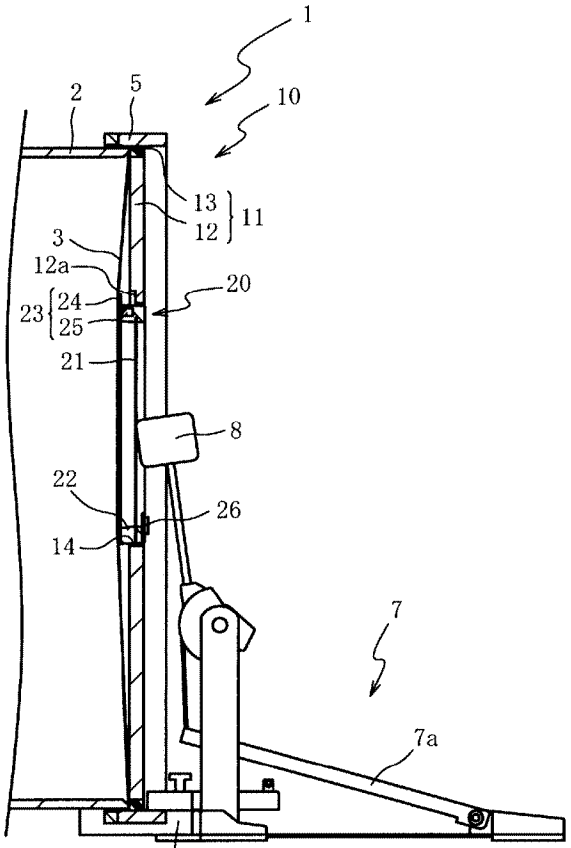
FIG. 4(*a*) is a cross-sectional view of the bass drum and the bass drum damper at the time of non-percussing, cut along line IVa-IVa in FIG. 1(*b*).
Figure 4A:
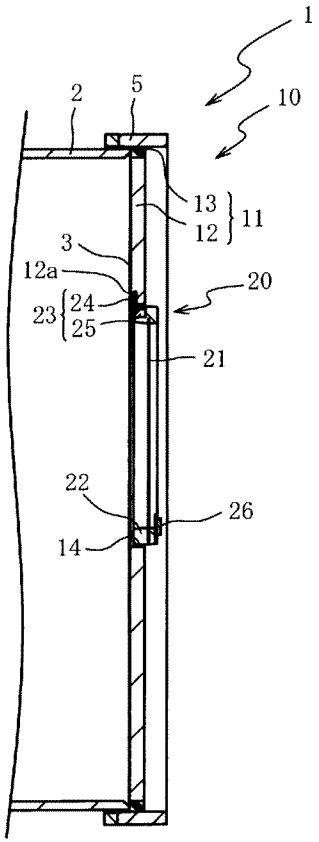

Next, the percussion target portion 20 will be described with reference to FIGS. 3(*a*), 3(*b*), and 4(*a*). FIG. 3(*a*) is a front view (view seen from the player side) of the percussion target portion 20. FIG. 3(*b*) is a rear view of the percussion target portion 20. FIG. 4(*a*) is a cross-sectional view of the bass drum 1 and the damper 10 at the time of non-percussing, cut along line IVa-IVa in FIG. 1(*b*). In FIG. 4(*a*), the hooks 6*a*, the lugs 6*b*, and the tuning bolts 6*c* are omitted and are not illustrated.

As illustrated in FIGS. 3(*a*), 3(*b*), and 4(*a*), the percussion target portion 20 is formed in a circular shape and is percussed instead of the batter head 3. The percussion target portion 20 vibrates integrally with the batter head 3, buffers an impact of percussing of the beater 8, and transfers the buffered impact to the batter head 3. The percussion target portion 20 covers the batter opening portion 3*a*. The percussion target portion 20 includes a batter portion 21, a frame portion 22, and the attachment tools 23.

A vibration sensor 26 constituted by a piezoelectric actuator is attached to the player side of the frame portion 22. Therefore, when the percussion target portion 20 is mounted in the bass drum 1, the bass drum 1 can be utilized as an electronic drum.

The batter portion 21 configures a batter percussed with the beater 8. The batter portion 21 is a film-like part formed of a flexible net-like material (having predetermined elasticity). The batter portion 21 is not limited to a net-like material and can be formed of a film-like material, or synthetic resin having elasticity, rubber, and the like. Due to its elasticity, the batter portion 21 can buffer an impact when the batter portion 21 is percussed and can buffer an impact transferred to the batter head 3 via the percussion target portion 20 at the time of percussing. As a result, when the percussion target portion 20 is percussed, the batter portion 21 can reduce a percussive sound generated from the percussion target portion 20 and can reduce a percussive sound generated from the batter head 3.

The frame portion 22 supports the circumferential edge of the batter portion 21 and is disposed on the player side of the batter head 3. The frame portion 22 is an annular synthetic resin member. Accordingly, compared to a case where the frame portion 22 is made of metal, the frame portion 22 can be reduced in weight. Since the percussion target portion 20 can be reduced in weight, the damper 10 can minimize an impact (reaction) received by the beater 8 due to inertia of the percussion target portion 20 when the percussion target portion 20 is percussed with the beater 8. As a result, the damper 10 can approximate the feeling to that when an acoustic bass drum 1 is percussed. In addition, in the damper 10, since the percussion target portion 20 can be reduced in weight, it is possible to suppress hindrance to free vibration of the batter head 3 when the percussion target portion 20 is percussed with the beater 8. As a result, the damper 10 can maintain the unique timbre of the acoustic bass drum 1. Moreover, since the frame portion 22 is made of synthetic resin, when the frame portion 22 is subjected to insert molding together with the batter portion 21 in a state where a tensile force is applied, the circumferential edge part of the batter portion 21 is fixed to the frame portion 22.

In the frame portion 22, the inner diameter is formed to have dimensions larger than the diameter of the batter opening portion 3*a* and the outer diameter is formed to have dimensions slightly smaller than the diameter of the opening portion 14. The difference between the outer diameter of the frame portion 22 and the diameter of the opening portion 14 preferably ranges from 1 mm to 20 mm and more preferably ranges from 2 mm to 10 mm. In the damper 10, when the difference between the outer diameter of the frame portion 22 and the diameter of the opening portion 14 becomes smaller, it is possible to further suppress a sound leakage from the opening portion 14, so that it is possible to further improve the percussive sound reducing performance. In the damper 10, when the difference between the outer diameter of the frame portion 22 and the diameter of the opening portion 14 becomes greater, it is possible to further suppress the contact of the percussed percussion target portion 20 with the sound insulating plate 11 (inner circumference of the opening portion 14). As a result, it is possible to suppress hindrance to free vibration of the batter head 3 caused due to contact between the percussion target portion 20 and the sound insulating plate 11.

The attachment tools 23 are members for providing a gap between the frame portion 22 and the batter head 3 and mounting the percussion target portion 20 on the batter head 3. The attachment tools 23 are provided in the frame portion 22 and are caused to adhere to the batter head 3 by means of an adhesive tape. A plurality of attachment tools 23 are disposed in the circumferential direction of the frame portion 22 and are attached around the batter opening portion 3*a* of the batter head 3. In the present embodiment, five attachment tools 23 are disposed at equal intervals in the circumferential direction of the frame portion 22. The attachment tools 23 are not limited to a case where five thereof are disposed, and four or less or six or more attachment tools 23 can be disposed. In the damper 10, compared to a case where the entire frame portion 22 adheres to the batter head 3, it is possible to minimize the contact surface area between the percussion target portion 20 and the batter head 3 by means of the attachment tools 23. As a result, it is possible to suppress hindrance to free vibration of the batter head 3 caused due to contact with the percussion target portion 20.

The attachment tools 23 are rubber members. The attachment tools 23 are not limited to being made of rubber, and synthetic resin attachment tools 23 having elasticity can be used. Since the attachment tools 23 have elasticity, the attachment tools 23 can buffer an impact transferred to the batter head 3 from the percussion target portion 20 due to percussing of the beater 8, and a percussive sound can be reduced.

The attachment tool 23 includes the disk portion 24 and a shaft portion 25. An adhesive tape is stuck on the disk portion 24, which adheres to the batter head 3. Since adhesion surface areas between the batter head 3 and the attachment tools 23 can be ensured, the disk portions 24 can make the percussion target portion 20 unlikely to be fall off from the batter head 3. The shaft portion 25 is formed in a columnar shape, is erected on the disk portion 24, and is fixed to the frame portion 22.

Next, with reference to FIG. 4(*b*) in addition to FIG. 4(*a*), a function of the damper 10 will be described. FIG. 4(*b*) is a cross-sectional view of the bass drum 1 and the damper 10 illustrating a state where the percussion target portion 20 is percussed. FIG. 4(*b*) illustrates a view in which the hook 6*a*, the lugs 6*b*, and the tuning bolts 6*c* are omitted.

As illustrated in FIG. 4(*a*), at the time of non-percussing of the beater 8, substantially the entire surface of one surface of the contact portion 12 is in contact with the batter head 3. As illustrated in FIG. 4(*b*), when the percussion target portion 20 is percussed with the beater 8, the batter head 3 is pressed by the beater 8 via the percussion target portion 20. Therefore, the batter head 3 is separated from the sound insulating plate 11 (contact portion 12), and the contact surface area between the batter head 3 and the sound insulating plate 11 is reduced. Since hindrance to free vibration of the batter head 3 caused due to contact between the batter head 3 and the sound insulating plate 11 can be suppressed, the damper 10 can maintain the unique timbre of the acoustic bass drum 1.

When the beater 8 is separated from the percussion target portion 20 after percussing of the beater 8, and when the batter head 3 is no longer pressed by the beater 8 via the percussion target portion 20, the batter head 3 moves toward the sound insulating plate 11. Accordingly, the contact surface area between the batter head 3 and the sound insulating plate 11 increases. Since the damper 10 can attenuate vibration of the batter head 3 in an early stage due to contact between the batter head 3 and the sound insulating plate 11, a percussive sound after percussing can be reduced. Therefore, the damper 10 can reduce a percussive sound and can maintain the unique timbre of the acoustic bass drum 1.

At the time of non-percussing, substantially the entire surface of one surface of the contact portion 12 (surface on the batter head 3 side) is in contact with the batter head 3, that is, the sound insulating plate 11 (contact portion 12) and the batter head 3 are in tight contact with each other. Therefore, when the percussion target portion 20 is percussed with the beater 8 and the batter head 3 is separated from the sound insulating plate 11 (contact portion 12), a space between the sound insulating plate 11 and the batter head 3 is reduced in pressure. Accordingly, the damper 10 can make the batter head 3 unlikely to be separated from the sound insulating plate 11 at the time of percussing. Therefore, the vibration amplitude of the batter head 3 can be minimized, and a percussive sound can be reduced. Moreover, in the damper 10, the fixing portion 13 and the hoop 5 are sealed by the fixing portion 13 press-fitted into the hoop 5. Therefore, an approach path of air between the sound insulating plate 11 and the batter head 3 can be limited to the opening portion 14 side. As a result, the damper 10 can make the batter head 3 less likely to be separated from the sound insulating plate 11. Therefore, the vibration amplitude of the batter head 3 can be further minimized, and a percussive sound can be further reduced. In addition, in the damper 10, since the batter opening portion 3*a* is located at a location of the percussion target portion 20 which is a part where the vibration amplitude of the batter head 3 is maximized at the time of percussing, a percussive sound can be reduced.

The damper 10 can prevent interference between the disk portions 24 and the contact portion 12 by means of the stepped portion 12*a*. Therefore, the contact surface area between the batter head 3 and the contact portion 12 can be ensured. In the damper 10, it is possible to ensure the vibration attenuating performance of the batter head 3 after percussing due to contact with the sound insulating plate 11. Therefore, it is possible to ensure the percussive sound reducing performance. In addition, the dimensions of the outer diameter of the fixing portion 13 are set such that the fixing portion 13 press-fitted into the hoop 5 is prevented from moving with respect to the hoop 5 due to vibration, an impact, and the like at the time of playing. As a result, in the damper 10, it is possible to prevent the percussive sound reducing performance from deteriorating during playing, so that it is possible to ensure the percussive sound reducing performance.

Since the fixing portion 13 is made of soft polyurethane foam, the fixing portion 13 can attenuate vibration of the batter head 3 via the contact portion 12. Accordingly, in the damper 10, the percussive sound reducing performance of the sound insulating plate 11 can be improved. In addition, in the damper 10, since the fixing portion 13 is fixed to the hoop 5, it is possible to suppress hindrance to free vibration of the batter head 3 compared to a case where the fixing portion 13 is fixed to the batter head 3.

When the fixing portion 13 is fixed to the hoop 5, vibration from the batter head 3 at the time of percussing is transferred to the hoop 5 via the fixing portion 13, so that there is a possibility that the shell 2 (bass drum 1 in its entirety) will vibrate and abnormal noise will be generated. However, since the fixing portion 13 is made of soft polyurethane foam, the damper 10 can attenuate vibration transferred to the hoop 5 via the fixing portion 13. Thus, the damper 10 can suppress generation of abnormal noise caused when the shell 2 (bass drum 1 in its entirety) vibrates.

The frame portion 22 made of synthetic resin has rigidity higher than that of the batter portion 21 formed of a net-like material. Therefore, vibration of the frame portion 22 can be simplified compared to vibration of the percussed batter portion 21 or vibration of the percussed batter head 3. In the damper 10, since the vibration sensor 26 is attached to the frame portion 22 having simple vibration, it is possible to suppress erroneous detection of vibration and to improve accuracy of detecting vibration.

Depending on the length of the beater 8 set in accordance with preferences of a player, the percussion location for the beater 8 varies vertically. In addition, when a player uses a twin pedal having two beaters 8, instead of the foot pedal 7, the percussion location for the beater 8 is split transversely. The dimensions of the batter portion 21 are set such that the batter portion 21 is located at the percussion locations for the beater 8. When the vibration sensor 26 is attached to the batter portion 21, sensitivity of the vibration sensor 26 sometimes fluctuates depending on the percussion location for the beater 8. In the present embodiment, the vibration sensor 26 is attached to the frame portion 22 supporting the circumferential edge of the batter portion 21. Therefore, in the damper 10, even if the percussion location for the beater 8 varies, sensitivity distribution of the vibration sensor 26 can be uniform.

In the damper 10, vibration of the batter head 3 after percussing can be attenuated in an early stage by the sound insulating plate 11. Therefore, it is possible to expect that vibration of the percussion target portion 20 which vibrates integrally with the batter head 3 will also be attenuated in an early stage. The vibration sensor 26 is attached to the frame portion 22 of the percussion target portion 20. Therefore, in the damper 10, it is possible to expect that erroneous detection of vibration after percussing will be suppressed and accuracy of detecting vibration at the time of percussing will be improved.

When a player beats an acoustic snare drum or a tam-tam (not illustrated) placed near the bass drum 1 to which the vibration sensor 26 is attached, the batter head 3 of the bass drum 1 is sometimes resonant therewith. The vibration sensor 26 may detect vibration of the batter head 3 caused due to the resonance and a speaker or the like connected to the vibration sensor 26 may erroneously produce a sound. However, in the present embodiment, the sound insulating plate 11 is in contact with the batter head 3. Therefore, in the damper 10, it is possible to suppress vibration of the batter head 3 caused due to resonance and to minimize vibration of the batter head 3 even if the batter head 3 resonates. Therefore, in the damper 10, it is possible to suppress erroneous detection of vibration of the batter head 3 caused due to resonance and to suppress erroneous sound production.

Next, with reference to FIGS. 5 and 6, a bass drum damper 31 (hereinafter, will be referred to as a "damper 31") according to a second embodiment will be described. In the first embodiment, a case where the percussion target portion 20 is mounted on the surface of the batter head 3 on the player side has been described. In contrast, in the second embodiment, a case where a percussion target portion 40 is mounted on a surface of the batter head 3 on the resonance head 4 side will be described. The same reference signs are applied to the same parts as those in the first embodiment, and descriptions thereof will be omitted.

Figure 5:
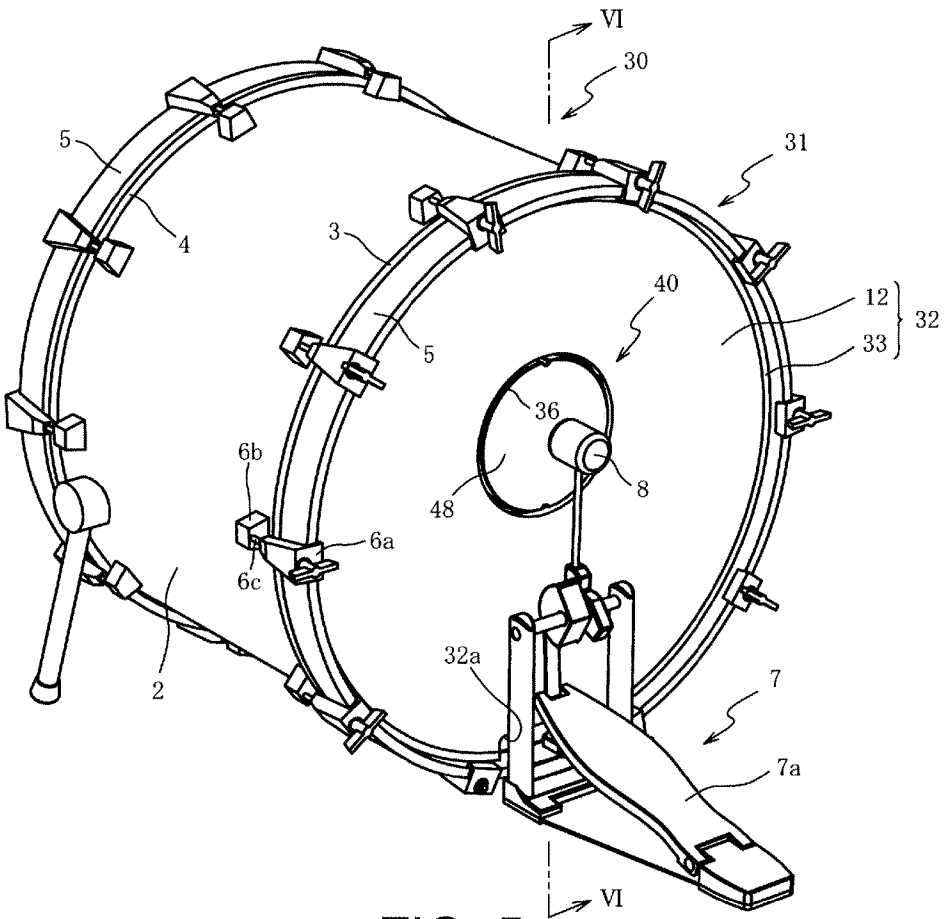
FIG. 5 is a perspective view of a bass drum in which a bass drum damper according to a second embodiment is mounted.
Figure 6:
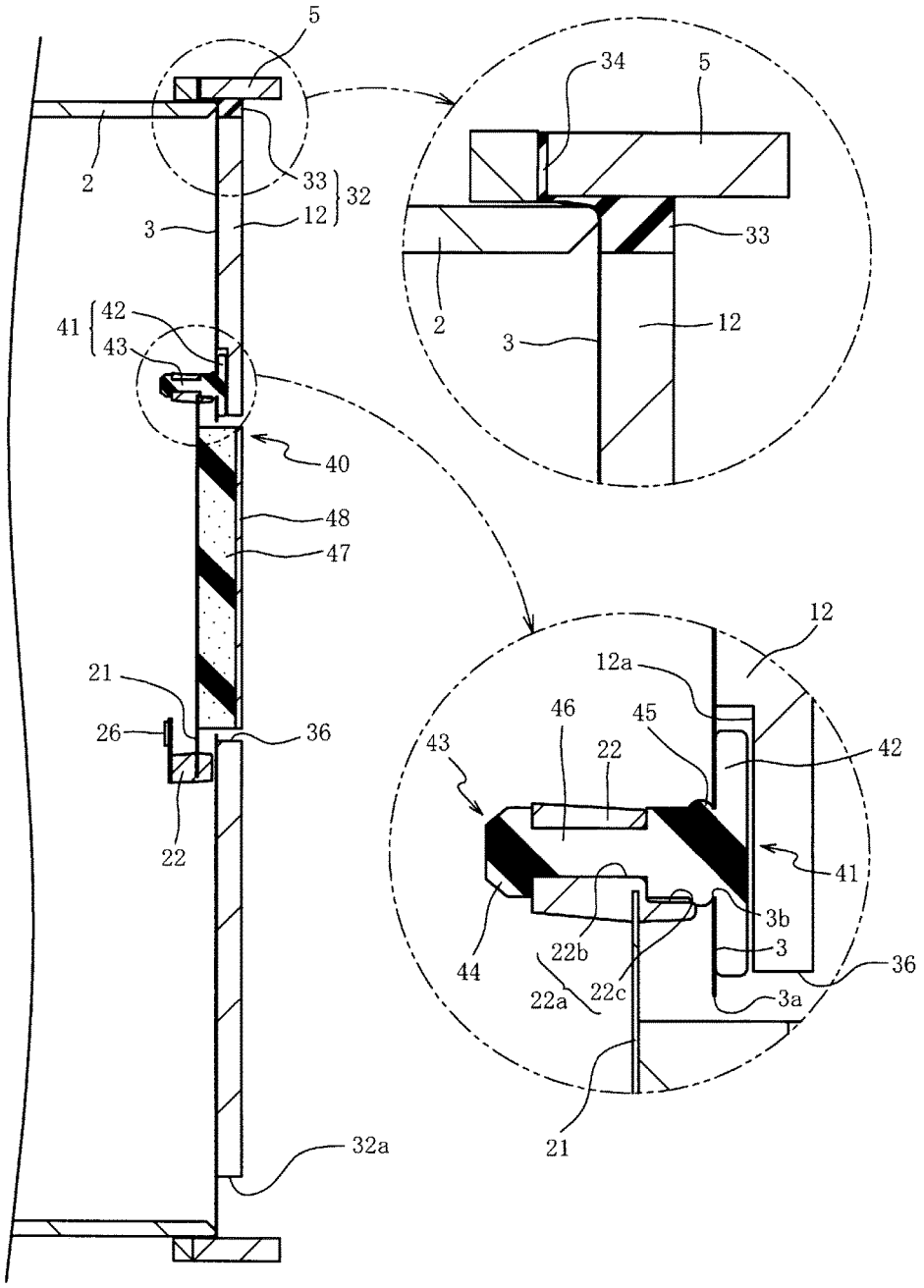
FIG. 6 is a view of an end surface of a cut portion of the bass drum and the bass drum damper at the time of non-percussing, cut along line VI-VI in FIG. 5.

FIG. 5 is a perspective view of a bass drum 30 in which the damper 31 according to the second embodiment is mounted. FIG. 6 is a view of an end surface of a cut portion of the bass drum 30 and the damper 31 at the time of non-percussing, cut along line VI-VI in FIG. 5. As illustrated in FIGS. 5 and 6, the damper 31 is mounted in the bass drum 30 and reduces the volume of a sound generated at the time of playing. The damper 31 includes a sound insulating plate 32 and the percussion target portion 40. The percussion target portion 40 is formed in a circular shape and is mounted on the surface of the batter head 3 on the resonance head 4 side. The percussion target portion 40 bulges out to the player side through the batter opening portion 3*a* and is percussed with the beater 8, instead of the batter head 3.

The sound insulating plate 32 is formed in a disk shape and covers the batter head 3. The sound insulating plate 32 reduces a percussive sound by shutting out the percussive sound generated from the batter head 3. The sound insulating plate 32 includes the contact portion 12 and a fixing portion 33. The contact portion 12 is a wooden member having a disk shape and is in contact with the batter head 3. In the contact portion 12, a circular opening portion 36 penetrating the contact portion 12 in the plate thickness direction is provided substantially at the center. In the contact portion 12, the stepped portion 12*a* is provided on a surface on the batter head 3 side so as to avoid a disk portion 42 of an attachment tool 41 (described below).

The fixing portion 33 is made of urethane rubber and is formed in an annular shape. The fixing portion 33 is provided on substantially the entire circumference of the circumferential edge of the contact portion 12. In the fixing portion 33, an extension portion 34 which is made of urethane rubber and extends outward in the axial direction of the fixing portion 33 from the circumferential edge along the hoop 5 is integrally formed. The extension portion 34 is not limited to being made of urethane rubber and can be made of non-metal or metal different from the material of the fixing portion 33. In this case, the fixing portion 33 and the extension portion 34 are integrated with each other by causing the extension portion 34 to be embedded in the fixing portion 33 or causing the extension portion 34 to adhere to the fixing portion 33.

The fixing portion 33 adheres to the outer circumferential surface of the contact portion 12. When the hoop 5 is attached to the batter head 3 in a state of overlapping the sound insulating plate 32, the extension portion 34 is interposed between the batter head 3 and the hoop 5, and the sound insulating plate 32 is fixed to the shell 2. Accordingly, in the damper 31, it is possible to prevent the sound insulating plate 32 from being separated from the batter head 3 due to vibration, an impact, and the like at the time of playing.

The opening portion 36 is a circular hole open for the percussion location for the beater 8. Therefore, the beater 8 can percuss the percussion target portion 40 through the opening portion 36. The opening portion 36 is disposed concentrically with respect to the batter opening portion 3*a* when the sound insulating plate 32 is mounted in the bass drum 30 and has a diameter slightly larger than that of the batter opening portion 3*a*. Accordingly, in the damper 31, it is possible to minimize a gap between the percussion target portion 40 bulging out from the batter opening portion 3*a*, and the opening portion 36. Moreover, it is possible to suppress the contact of the percussed percussion target portion 40 with the sound insulating plate 32 (inner circumference of the opening portion 36). As a result, in the damper 31, it is possible to minimize a sound leakage from between the percussion target portion 40 and the opening portion 36 and it is possible to suppress hindrance to free vibration of the batter head 3 caused due to contact between the percussion target portion 40 and the sound insulating plate 32.

The percussion target portion 40 is percussed with the beater 8 instead of the batter head 3, so that the percussion target portion 40 vibrates integrally with the batter head 3, buffers an impact of percussing of the beater 8, and transfers the buffered impact to the batter head 3. The percussion target portion 40 is mounted on the surface of the batter head 3 on the resonance head 4 side and bulges out to the player side from the batter opening portion 3*a*. Accordingly, in the percussion target portion 40, the percussion location when percussed with the beater 8 can approximate to the percussion location when the batter head 3 is directly percussed. Therefore, there is no need to provide a spacer between the bass drum 30 and the foot pedal 7, and the foot pedal 7 can be directly mounted in the bass drum 30. Since the foot pedal 7 is directly mounted in the bass drum 30, the sound insulating plate 32 is provided with a notch portion 32*a* notched at the edge in a lower portion so as not to interfere with the foot pedal 7.

The percussion target portion 40 includes the batter portion 21, the frame portion 22, the attachment tool 41, a cushioning portion 47, and a hard body 48. The frame portion 22 is disposed on the resonance head 4 side of the batter head 3. The cushioning portion 47 and the hard body 48 are parts bulging out to the player side from the batter opening portion 3*a*.

The vibration sensor 26 constituted by a piezoelectric actuator is attached to the resonance head 4 side of the frame portion 22 of the percussion target portion 40. Therefore, in the damper 31, when the percussion target portion 40 is mounted in the bass drum 30, the bass drum 30 can be utilized as an electronic drum. Examples of connecting wiring (not illustrated) from the vibration sensor 26 to external equipment (not illustrated) of the bass drum 30 include a case where the wiring passes between the percussion target portion 40 and the opening portion 36, and a case where the wiring passes through holes (not illustrated) bored at arbitrary locations in the batter head 3 and the sound insulating plate 32.

The attachment tool 41 is a rubber pin for attaching the frame portion 22 to the batter head 3. The attachment tool 41 includes the disk portion 42 and a shaft portion 43. The shaft portion 43 is a columnar part erected at the center of the disk portion 42. When the shaft portion 43 is press-fitted into a penetration hole 22*a* having a circular cross section provided in a manner penetrating the frame portion 22 in the axial direction and a penetration hole 3*b* provided in a manner penetrating the batter head 3 in the film thickness direction in a circular shape, the percussion target portion 40 is mounted in the batter head 3. The attachment tool 41 is not limited to being made of rubber and a synthetic resin attachment tool 41 having elasticity can be used.

The penetration hole 22*a* includes a small diameter portion 22*b* and a large diameter portion 22*c*. The large diameter portion 22*c* is located on the batter head 3 side of the small diameter portion 22*b* and has a diameter larger than that of the small diameter portion 22*b*. The penetration holes 22*a* are provided at five places at equal intervals in the circumferential direction of the frame portion 22. The penetration hole 3*b* is a hole having a diameter substantially the same as that of the large diameter portion 22*c*. The penetration holes 3*b* are provided on the circumference of the batter opening portion 3*a* at locations corresponding to the penetration holes 22*a*.

The shaft portion 43 has a diameter substantially the same as those of the penetration hole 3*b* and the large diameter portion 22*c*. The shaft portion 43 includes a tip portion 44, an annular portion 45, and a groove portion 46.

The tip portion 44 is a part for facilitating insertion of the shaft portion 43 into the penetration hole 22*a* and the penetration hole 3*b*. The tip portion 44 is formed in a tapered manner being gradually reduced in diameter toward the tip. The annular portion 45 is a part for facilitating insertion of the shaft portion 43 into the penetration hole 3*b* and fixing the shaft portion 43 to the batter head 3 by causing the batter head 3 to be fitted between the disk portion 42 and the annular portion 45. The annular portion 45 increases in diameter in an annular manner while having a clearance which corresponds to the film thickness of the batter head 3 and is provided between the disk portion 42 and the annular portion 45. The groove portion 46 is a recessed part provided between the tip portion 44 and the annular portion 45. The groove portion 46 has a diameter substantially the same as that of the small diameter portion 22*b* and has a length substantially the same as that of the small diameter portion 22*b*. Therefore, when the small diameter portion 22*b* is fitted into the groove portion 46, the shaft portion 43 can be fixed to the frame portion 22.

The shaft portion 43 is set to have a length from the disk portion 42 to the groove portion 46 longer than the length of the large diameter portion 22*c* of the penetration hole 22*a*. Therefore, the damper 31 is provided with a gap between the frame portion 22 and the batter head 3, and the percussion target portion 40 can be mounted in the batter head 3. In the damper 31, compared to a case where the entire frame portion 22 adheres to the batter head 3, it is possible to minimize the contact surface area between the percussion target portion 40 and the batter head 3 by means of the attachment tool 41. As a result, it is possible to suppress hindrance to free vibration of the batter head 3 caused due to contact with the percussion target portion 40.

The cushioning portion 47 has a columnar shape, is made of soft polyurethane foam, and is attached to a surface of the batter portion 21 on the player side. The cushioning portion 47 is formed to have dimensions such that the outer diameter is slightly smaller than the diameter of the batter opening portion 3*a*. Accordingly, it is possible to prevent the cushioning portion 47 from being in contact with the batter head 3 (inner circumference of the batter opening portion 3*a*) at the time of percussing. As a result, in the damper 31, it is possible to suppress hindrance to free vibration of the batter head 3 and the percussion target portion 40 connected to each other via the rubber attachment tool 41.

The hard body 48 is woven fabric having a circular shape and is provided on a surface on a side opposite to the surface attached to the batter portion 21 of the cushioning portion 47. The hard body 48 is harder than the cushioning portion 47 and is formed to have dimensions substantially the same as the dimensions of the outer diameter of the cushioning portion 47. The cushioning portion 47 is not limited to being made of soft polyurethane foam, and different soft foamed synthetic resin can be used. The hard body 48 is not limited to woven fabric, and non-woven fabric, a rubber sheet or the like can be used. It is preferable that the hard body 48 be harder than the cushioning portion 47 and have high abrasion resistance.

When the hard body 48 is percussed with the beater 8, the damper 31 can buffer an impact to the batter portion 21 by means of the cushioning portion 47. Accordingly, in the damper 31, it is possible to reduce a percussive sound generated when the percussion target portion 40 is percussed. Since the hard body 48 is harder than the cushioning portion 47, the hard body 48 is unlikely to warp. Accordingly, although the percussion location for the beater 8 is substantially constant, in the damper 31, it is possible to disperse an impact applied to the cushioning portion 47 or the batter portion 21 from the hard body 48 at the time of percussing. Accordingly, it is possible to suppress deterioration of a part of the cushioning portion 47 caused due to an impact concentrated on a part of the cushioning portion 47 and the batter portion 21, and it is possible to suppress stretching of a part of the batter portion 21. As a result, in the damper 31, durability of the cushioning portion 47 and the batter portion 21 can be improved.

The percussion target portion 40 is a surface percussed with the beater 8. The percussion target portion 40 is set such that the height from the batter head 3 to the hard body 48, which is a surface located closest to the player side, becomes the same as the height from the batter head 3 to a surface of the sound insulating plate 32 on the player side. Accordingly, the appearance of the bass drum 30 to which the damper 31 is attached can be improved.

Hereinabove, the embodiments have been described. The present invention is not limited to the embodiments in any way, and it can be easily assumed that various modifications and changes can be made within the scope not departing from the gist of the present invention. For example, in each of the embodiments, a case where the percussion target portion 20 or 40 is mounted in the batter head 3 has been described, but the embodiments are not necessarily limited thereto. Naturally, the percussion target portions 20 and 40 can be omitted. In this case, the beater 8 can directly percuss the batter head 3 through the opening portions 14 and 36 by omitting the batter opening portion 3*a* provided in the batter head 3 at the locations where the percussion target portion 20 or 40 is mounted.

In the first embodiment, a case where the batter opening portion 3*a* is provided in the batter head 3 has been described, but the embodiment is not necessarily limited thereto. Naturally, the batter opening portion 3*a* can be omitted. That is, naturally, the percussion target portion 20 can be mounted in the batter head 3 without providing the batter opening portion 3*a*.

In the first embodiment, a case where the percussion target portion 20 is mounted on the surface of the batter head 3 on the player side has been described. In addition, in the second embodiment, a case where the percussion target portion 40 is mounted on the surface of the batter head 3 on the resonance head 4 side has been described. However, the embodiments are not necessarily limited thereto. Naturally, the percussion target portion can be mounted in the batter head 3 by causing the batter head 3 and the batter portion 21 to be interposed between a pair of frame portions on both sides in a state where the batter portion 21 is disposed at the location of the batter opening portion 3*a*.

In the first embodiment, the percussion target portion 20 including the batter portion 21, the frame portion 22, and the attachment tools 23 has been described. In addition, in the second embodiment, the percussion target portion 40 including the cushioning portion 47 and the hard body 48 in addition to the batter portion 21, the frame portion 22, and the attachment tool 41 has been described. However, the embodiments are not necessarily limited thereto. Naturally, the batter portion 21, the frame portion 22, and the attachment tools 23 and 41 can be omitted and the cushioning portion 47 can be directly attached to the batter head 3 in an adhesive manner or the like. In addition, the batter portion 21 can be omitted and the circumferential edge of the cushioning portion 47 can be supported by the frame portion 22. In addition, the attachment tools 23 can be omitted and the entire frame portion 22 can be attached to the batter head 3.

In addition, naturally, the cushioning portion 47 and the hard body 48 can be applied to the percussion target portion 20. In this case, when the height of the hard body 48 with respect to the batter portion 21 is set so as to be the same as the height of the frame portion 22 with respect to the batter portion 21, the appearance of the percussion target portion 20 can be improved. Moreover, it is possible to set the height of the percussion target portion 20 (the frame portion 22 and the hard body 48) with respect to the batter head 3 and the height of the sound insulating plate 11 with respect to the batter head 3 to be the same as each other. Accordingly, the appearance of the bass drum 1 to which the damper 10 is attached can be further improved.

In each of the embodiments, a case where the fixing portion 13 or 33 is provided on substantially the entire circumference of the circumferential edge of the contact portion 12 has been described, but the embodiments are not necessarily limited thereto. Naturally, the fixing portion can be provided at a part of the circumferential edge of the contact portion 12.

In each of the embodiments, a case where the fixing portion 13 or 33 is fixed to the hoop 5 has been described, but the embodiments are not necessarily limited thereto. The fixing portion can adhere and be fixed to the batter head 3. In this case, a part of the batter head 3 can be covered with the sound insulating plate by setting the dimensions or the shape of the fixing portion (sound insulating plate) such that a predetermined gap is generated between the fixing portion and the hoop 5. In addition, the fixing portion can be fixed to the batter head 3 by causing the fixing portion to be interposed between the hook 6*a* and the batter head 3. In addition, the fixing portion can adhere and be fixed to the hoop 5.

In each of the embodiments, a case where the contact portion 12 is a wooden member has been described, but the embodiments are not necessarily limited thereto. The material of the contact portion can be suitably changed as long as the contact portion has rigidity to the extent that the contact portion does not come into contact with the batter head 3 pressed by the beater 8, even if the contact portion is deformed due to an impact at the time of percussing. Examples of the contact portion include a synthetic resin contact portion and a rubber contact portion. Particularly, when hard foamed synthetic resin or foamed rubber is used for the contact portion, sound-absorption characteristics of the contact portion (sound insulating plate) can be improved, and a percussive sound can be reduced. Examples of hard foamed synthetic resin include polyurethane foam, polyisocyanurate foam, phenol foam, polystyrene foam, polyethylene foam, and polypropylene foam.

In the first embodiment, a case where the fixing portion 13 is made of soft polyurethane foam has been described. In addition, in the second embodiment, a case where the fixing portion 33 is made of urethane rubber has been described. However, the embodiments are not necessarily limited thereto. Naturally, different soft foamed synthetic resin (polyethylene foam, polyolefin foam, polyvinyl chloride foam, melamine foam, polyimide foam, or the like) or other rubber can be used for the fixing portion. In addition, synthetic resin such as a thermoplastic elastomer having elasticity can be used for the fixing portion. When the materials of the contact portion and the fixing portion are the same as each other, the contact portion and the fixing portion can be integrally molded. In addition, even when the materials of the contact portion and the fixing portion are different from each other, the contact portion and the fixing portion can be integrally molded depending on the combination of the materials by heat-sealing the contact portion and the fixing portion through two color molding or the like.

In each of the embodiments, a case where the resonance side sound insulating plate 15 is made of soft polyurethane foam has been described, but the embodiments are not necessarily limited thereto. The material of the resonance side sound insulating plate 15 can be suitably changed. For example, naturally, other synthetic resin, rubber, wood, and fabric can be used for the resonance side sound insulating plate. Particularly, in the bass drum damper, when foamed synthetic resin or foamed rubber is used for the resonance side sound insulating plate, sound-absorption characteristics of the resonance side sound insulating plate can be improved, and a percussive sound can be reduced.

In the first embodiment, a case where the resonance side sound insulating plate 15 is interposed and is fixed between the end portion of the shell 2 and the resonance head 4 has been described, but the embodiments are not necessarily limited thereto. Naturally, synthetic resin or rubber having elasticity can be provided at the circumferential edge of the resonance side sound insulating plate 15, the resonance side sound insulating plate 15 can be press-fitted into the shell 2 and be fixed thereto, or the resonance side sound insulating plate 15 can adhere and be fixed to the resonance head 4. When the resonance side sound insulating plate 15 adheres to the resonance head 4, it is preferable that the resonance side sound insulating plate 15 adhere to a surface of the resonance head 4 on the batter head 3 side with its entire surface such that the resonance side sound insulating plate 15 is prevented from being in contact with the shell 2. In this case, it is preferable that the resonance side sound insulating plate 15 be made of soft polyurethane foam having an outer diameter slightly smaller than the inner diameter of the shell 2 and a thickness of approximately 10 mm. In addition, the resonance side sound insulating plate 15 can also adhere to a surface on a side opposite to the batter head 3 side of the resonance head 4. In this case, since the resonance head 4 and the resonance side sound insulating plate 15 adhere to each other, the resonance side sound insulating plate 15 can be prevented from being separated from the resonance head 4 due to an impact at the time of percussing.

In addition, the resonance head 4 can be omitted, and the circumferential edge of the resonance side sound insulating plate 15 can be pressed by the hoop 5 so that only the resonance side sound insulating plate 15 is fixed to the shell 2. Moreover, regardless of the presence or absence of the resonance head 4, the resonance side sound insulating plate 15 can be omitted.

In addition, an opening can be provided in the resonance head 4, and the opening can be blocked with the resonance side sound insulating plate 15 from the inner side (batter head 3 side) of the resonance head 4. In this case, the resonance side sound insulating plate 15 has an outer diameter which is the same as or slightly smaller than the inner diameter of the shell 2, is formed of foamed synthetic resin having a thickness of approximately several millimeters, and has predetermined air permeability. That is, the resonance side sound insulating plate 15 having air permeability adheres to the inner side of the resonance head 4 provided with the opening. Accordingly, in the bass drum damper, air compressed inside the shell 2 when the batter head 3 is percussed can be appropriately discharged to the outside of the shell 2 through the opening provided in the resonance head 4 and the resonance side sound insulating plate 15. As a result, in the bass drum damper, vibration of the resonance head 4 can be suppressed, and a percussive sound can be reduced. In the bass drum damper, air inside the shell 2 can be more appropriately discharged to the outside by causing only the outer circumference side of the resonance side sound insulating plate 15 to adhere to the resonance head 4, and a percussive sound can be further reduced.

In the first embodiment, a case where the attachment tools 23 are caused to adhere to the batter head 3 by means of an adhesive tape and the percussion target portion 20 is mounted in the batter head 3 has been described. In addition, in the second embodiment, a case where the percussion target portion 40 is mounted in the batter head 3 by means of the attachment tool 41 which is a pin has been described. However, the embodiments are not necessarily limited thereto. Naturally, the percussion target portion can be mounted in the batter head 3 using suction pads, adhesives, bolts and nuts, or the like as the attachment tools.

In each of the embodiments, a case where the vibration sensor 26 constituted by the piezoelectric actuator is attached to the percussion target portion 20 or 40 has been described, but the embodiments are not necessarily limited thereto. Naturally, an electromagnetic induction-type vibration sensor or an electrostatic capacitance-type vibration sensor can be used. In addition, the bass drum 1 or 30 in which the damper 10 or 31 is mounted without attaching the vibration sensor 26 can be used as a bass drum for practice.

A weight can be attached to the percussion target portion 20 or 40 according to the first or second embodiment. In the damper 10 or 31, vibration of the batter head 3 in which the percussion target portion 20 or 40 is mounted can be suppressed due to the mass of the weight, and a percussive sound can be reduced. For example, in the second embodiment, a plate material made of, for example, iron having an outer diameter which is substantially the same as the outer diameter of the frame portion 22 of the percussion target portion 40 can serve as the weight, and the plate material can be fixed to the resonance head 4 side of the frame portion 22 by means of the attachment tool 41. More specifically, the plate material is provided with a penetration hole having the same diameter at the same location as the small diameter portion 22*b* of the penetration hole 22*a* of the frame portion 22, and the shaft portion 43 of the attachment tool 41 is press-fitted into the penetration hole 22*a* of the frame portion 22. Thereafter, the plate material can be attached to the percussion target portion 40 by causing the shaft portion 43 to be press-fitted into the penetration hole of the plate material. Moreover, it is possible to adjust the mass of the weight (plate material) attached to the percussion target portion 40, by mounting a different plate material in that plate material using bolts and nuts, rivets, or the like, or changing the material or the thickness of the plate material so as to change the mass of the plate material.

In addition, vibration from the percussion target portion 40 can be transferred to the vibration sensor 26 in an equivalent manner by attaching the vibration sensor 26 at the center on the resonance head 4 side of the plate material attached to the percussion target portion 40. As a result, in the bass drum damper, even if the percussion location for the beater 8 varies, sensitivity distribution of the vibration sensor 26 can be uniform.

In addition, a cushion such as foamed synthetic resin can be interposed between the plate material attached to the percussion target portion 40 and the batter portion 21. Since vibration of air between the plate material and the batter portion 21 can be suppressed due to the cushion, a percussive sound can be further reduced by the bass drum damper.

What is claimed is:

1. A bass drum damper comprising:

a sound insulating plate that covers a batter head of an acoustic bass drum generating a percussive sound when a beater of a foot pedal percusses a predetermined percussion location, wherein the sound insulating plate comprises a contact portion which has an opening portion open for the percussion location for the beater and is in contact with the batter head, and a fixing portion which is provided at a circumferential edge of the contact portion and is fixed to a hoop applying a tensile force to the batter head, or the batter head, and wherein at least a part of the contact portion which is in contact with the batter head when not being percussed is separated from the batter head at a time of percussing of the beater and is brought into contact with the batter head again after percussing, and during the batter head being pressed by the beater, the part of the contact portion which is separated from the batter head at the time of percussing of the beater has a rigidity that the contact portion does not come into contact with the batter head.

2. The bass drum damper according to claim 1, wherein the fixing portion is made of synthetic resin or rubber having elasticity and is fixed to the hoop in a manner in contacting with the hoop.

3. The bass drum damper according to claim 1, comprising:

a resonance side sound insulating plate that is in contact with a resonance head of the bass drum.

4. The bass drum damper according to claim 1, comprising:

a percussion target portion that has predetermined elasticity, is disposed at the percussion location for the beater, and is mounted on the batter head.

5. The bass drum damper according to claim 4, wherein the percussion target portion blocks the opening portion such that the percussion target portion is not in contact with an inner circumference of the opening portion.

6. The bass drum damper according to claim 4, wherein a height of the sound insulating plate with respect to the batter head and a height of the percussion target portion with respect to the batter head are the same.

7. The bass drum damper according to claim 4, wherein the percussion target portion comprises a batter portion which has predetermined elasticity and is percussed with the beater, and a frame portion which supports a circumferential edge of the batter portion and has rigidity set to be higher than rigidity of the batter portion, and the bass drum damper comprises a vibration sensor which is attached to the frame portion and detects vibration.

8. A damper for a bass drum comprising a batter head, a hoop applying a tensile force to the batter head and a percussion location, which is settable, wherein the damper comprises:

a sound insulating plate fixed to the hoop or the batter head and having an opening portion and the sound insulating plate covers the batter head and contacts the batter head;

a percussion target portion disposed at the percussion location and mounted on the batter head, wherein at least a part of the sound insulating plate, that is in contact with the batter head, is separated from the batter head at a time of percussing the percussion location and is brought into contact with the batter head again after percussing.

9. The damper according to claim 8, wherein the sound insulating plate comprises a contact portion which contacts the batter head and a fixing portion which is provided at a circumferential edge of the contact portion, and the sound insulating plate contacts the batter head through the contact portion, and the sound insulating plate is fixed to the hoop or the batter head through the fixing portion.

10. The damper according to claim 9, wherein the fixing portion is made of synthetic resin or rubber having elasticity and is fixed to the hoop.

11. The damper according to claim 8, comprising:

a resonance side sound insulating plate that is in contact with a resonance head of the bass drum.

12. The damper according to claim 8, wherein the percussion target portion is formed of a net-like material, a film-like material, or synthetic resin having elasticity, or rubber.

13. The damper according to claim 8, wherein the percussion target portion blocks the opening portion such that the percussion target portion is not in contact with an inner circumference of the opening portion.

14. The damper according to claim 8, wherein a height of the sound insulating plate with respect to the batter head and a height of the percussion target portion with respect to the batter head are the same.

15. The damper according to claim 8, wherein the percussion target portion comprises a batter portion which has predetermined elasticity and receives percussion, and a frame portion which supports a circumferential edge of the batter portion and has rigidity set to be higher than rigidity of the batter portion.

16. The damper according to claim 15, comprises a vibration sensor which is attached to the frame portion and detects vibration.

17. The damper according to claim 8, wherein a batter opening portion is disposed in the batter head and is covered by the percussion target portion.

18. The damper according to claim 9, wherein the opening portion of the sound insulating plate is disposed in the contact portion of the sound insulating plate and the opening portion is located concentrically with respect to the batter opening portion and has a diameter larger than a diameter of the batter opening portion.

19. The damper according to claim 9, wherein the contact portion is made of a porous material.

20. An acoustic bass drum comprising:

a hoop;

a batter head to which a tensile force is applied by the hoop;

the bass drum damper according to claim 8; and a plurality of attachment tools provided at a circumferential edge of the percussion target portion, wherein the percussion target portion is mounted on the batter head via the plurality of attachment tools, and wherein the batter head comprises a batter opening portion open for a portion surrounded by the plurality of attachment tools.

* * * * *